US008863330B2

(12) United States Patent
Cohen

(10) Patent No.: US 8,863,330 B2
(45) Date of Patent: Oct. 21, 2014

(54) SYSTEM AND METHOD FOR SECURING A BED SKIRT TO A BOX SPRING

(71) Applicant: Hospitality Solutions Holdings, LLC, Jackson, WY (US)

(72) Inventor: Shirley J. Cohen, Fort Lauderdale, FL (US)

(73) Assignee: Hospitality Solutions Holdings, LLC, Jackson, WY (US)

( * ) Notice: Subject to any disclaimer, the term of this patent is extended or adjusted under 35 U.S.C. 154(b) by 17 days.

(21) Appl. No.: 13/709,912

(22) Filed: Dec. 10, 2012

(65) Prior Publication Data

US 2014/0157517 A1 Jun. 12, 2014

(51) Int. Cl.
*A47C 21/02* (2006.01)
*A47G 9/04* (2006.01)

(52) U.S. Cl.
CPC ..... *A47G 9/04* (2013.01)
USPC ..... 5/498; 5/486; 5/493

(58) Field of Classification Search
CPC ..... A47G 9/00; A47G 9/0284; A47G 9/0292; A47G 9/04; A47G 9/0238; A47C 21/022; A47D 15/02
USPC ..... 5/498, 663, 907, 922–923, 486, 493, 5/496
See application file for complete search history.

(56) References Cited

U.S. PATENT DOCUMENTS 2,653,363 A * 9/1953 Lievsay, Jr. ..... 24/72.5
2,673,356 A * 3/1954 Fleming ..... 5/498
2,789,292 A * 4/1957 Budinquest ..... 5/486
3,528,693 A * 9/1970 Ford et al. ..... 52/309.8
4,796,317 A * 1/1989 Kallman et al. ..... 5/493
4,979,251 A 12/1990 Lazar
5,086,531 A * 2/1992 Carlos ..... 5/493
5,105,492 A * 4/1992 Karpinski ..... 5/675
5,134,736 A * 8/1992 Anthony et al. ..... 5/496
5,335,383 A 8/1994 Schwind
5,621,931 A * 4/1997 Hamilton ..... 5/493
5,704,082 A * 1/1998 Smith ..... 5/493
5,715,553 A * 2/1998 Baron et al. ..... 5/493
5,733,397 A * 3/1998 McDaniel ..... 156/66
5,749,110 A * 5/1998 Gamble et al. ..... 5/493
6,035,469 A 3/2000 Schrougham (Continued)

OTHER PUBLICATIONS

Phillips Manufacturing Co., https://web.archive.org/web/20101127070035/http://phillipsmfg.com/products/vbt/square.htm, Nov. 27, 2010.*

*Primary Examiner* — William Kelleher
*Assistant Examiner* — Myles Throop
(74) *Attorney, Agent, or Firm* — Feldman Gale

(57) ABSTRACT

The present invention may include one or more L-shaped flanges each having a top member and a lateral member. The top member may also comprise a lower adhesive material. Additionally, the lateral member of the L-shaped flange may include a plurality of spaced apart holes whereby a securing device can be punched therethrough in order to secure the one or more L-shaped flanges to one or more edges of the box spring. A bed skirt decking having a top side and an underside is further provided, wherein a corresponding upper adhesive material is provided on the underside of the bed skirt decking. The corresponding upper adhesive material is aligned with the lower adhesive material located on the top member so that when they are secured to one another, the bed skirt is secured to the box spring and oriented to achieve its functional and aesthetic goals.

20 Claims, 3 Drawing Sheets

(56) References Cited

U.S. PATENT DOCUMENTS

| | | | | |
|---|---|---|---|---|
| 6,216,292 | B1 | 4/2001 | Oakhill et al. | |
| 6,557,193 | B1 | 5/2003 | Griffith | |
| 6,691,476 | B1 * | 2/2004 | Kunz | 52/287.1 |
| 6,883,192 | B1 | 4/2005 | Rose et al. | |
| 7,089,611 | B1 | 8/2006 | Jones et al. | |
| 7,207,078 | B1 | 4/2007 | Lakic | |
| 7,337,480 | B2 * | 3/2008 | Borino | 5/493 |
| 7,676,863 | B2 | 3/2010 | Henning | |
| 2007/0056099 | A1 * | 3/2007 | Langenberger | 5/493 |
| 2008/0222806 | A1 | 9/2008 | Hart | |
| 2011/0223782 | A1 | 9/2011 | Ales et al. | |
| 2011/0302716 | A1 | 12/2011 | Battaglia et al. | |
| 2012/0090092 | A1 | 4/2012 | Hart | |

* cited by examiner

SYSTEM AND METHOD FOR SECURING A BED SKIRT TO A BOX SPRING

FIELD OF THE INVENTION

Embodiments of the present invention generally relate to a system and method for securing a bed skirt to a box spring.

BACKGROUND OF THE INVENTION

Whether in a residential home or within the hotel and hospitality industry, keeping a bed skirt aligned with the box spring in order to maintain a perfectly made up bed can be a burdensome chore.

Generally, the bed skirt lies on top of a box spring and underneath the mattress. In order to maintain the bed skirt in its initial desired position, or to readjust and correct the placement of a bed skirt that has shifted from its initial desired position, the entire mattress must either be lifted up or removed for the bed skirt to be properly aligned, and once the bed skirt is aligned, the mattress must be lowered to its exact former position. The mattress cannot be slid into position, because the bed skirt will inevitably slide along with the mattress and thus out of position.

Because of the weight of mattresses today, the individual or "user" making the bed—whether it be in a residential setting or in the hotel and hospitality industry—will more likely attempt to tuck in the bed skirt if it appears to be dragging or too low, or alternatively, the user will pull down on the side of the bed skirt if the bed skirt appears too high or short. These solutions to obtaining the appropriate aesthetic and functional goal of the bed skirt are only temporary, if not impossible without lifting the mattress. As soon as the bed is turned down for use, or re-made the bed skirt will inevitably shift from its desired position on the box spring.

Furthermore, while tucking in the sheets and/or the duvet cover between the mattress and box spring, the bed skirt often "rides" along with the sheets and simultaneously gets tucked into the crevice between the mattress and the box spring. Pulling on the skirt to return it to its proper length while keeping the sheets and duvet tucked in takes time and effort which cannot practically be met, particularly in the hotel and hospitality industry in view of the number of beds and frequency in which those beds must be made by the staff. The problem is further compounded by the fact that, even if the bed skirt was adjusted every time the sheets were tucked between the mattress and the box spring, the bed skirt would once again fall out of alignment with the box spring each time the bedding is pulled back or "turned down" before the bed is to be used.

There are several problems associated with previously developed and currently utilized systems and methods for securing a bed skirt to a box spring. These previous solutions to attempt to maintain the bed skirt in a desired position still present drawbacks in terms of retaining functional and aesthetic appeal while promoting overall efficiency, particularly in hotel and hospitality settings. Problems also include the time expended each time these bed skirt issues must be addressed and the probability of back injuries to the user while addressing these issues.

For example, traditional bed skirts are generally manufactured to be placed on top of the box spring so that the bed skirt falls to the floor on three sides of the box spring without any system for attaching the skirt to the box spring. To compensate for this lack of an attachment system, the hotel and hospitality industry will often attach short strips of an adhesive hook and loop type fastener directly to the box spring and sew a corresponding adhesive hook and loop fastener to the underside or the bed skirt. These methods, however, are only a temporary fix as the adhesive on the fastener eventually weakens, and slides out of place causing the bed skirt to eventually slide out of position every time the bed is made or adjusted. When removing the skirt to launder, the adhesive hook and loop is not re-usable and no longer in original position.

Another attempted solution, called a bed hugger, involves attaching the bed skirt to the box spring along the underside of the bed skirt as well as along the bed skirt's side panels by a separate piece of lining fabric having an elastic gathered bottom edge, similar to a fitted sheet. While the goal of this elastic bottom edge is to keep the bed skirt in place, the elastic does nothing to stabilize or secure the skirt from sliding around. In practice the corners of the bed skirt generally tear or rip, and the elastic is usually insufficient in strength to prevent the bed skirt from sliding off of the edge of the box spring.

In addition, US Patent Publication Number 2008/0222806 discloses a bed skirt that is removable by a zipper or hook-and-loop fastener attached to the decking of the bed skirt, which lies on top of the box spring, but does not secure the bed skirt to the box spring in order to prevent the bed skirt from shifting.

U.S. Pat. No. 5,621,931 to Hamilton discloses a detachable bed skirt wherein a bed skirt without a decking is provided, thus leaving the underlying box spring exposed, and aesthetically unappealing.

U.S. Pat. No. 6,557,193 to Griffith teaches a device for maintaining the bed skirt in a desired position by means of a single tubular frame that is sized to fit over the entire perimeter of the box spring, or alternatively by providing a specifically-sized decking with a zipper assembly on one or more of its edges. Griffith, however, discloses a frame for easy removal and replacement of the bed skirting, and does not teach a system or method that facilities the chore of daily bed making by providing a device that firmly secures the bed skirt to the box spring and which does not obstruct the hands of the user when making the bed, particularly when tucking the sheets or duvet between the mattress and box spring.

Therefore, it is readily apparent that there is a need for a system and method for quickly and efficiently securing a bed skirt to a box spring. Moreover, because most existing bed skirt devices for securing a bed skirt in position are pre-fitted, there exists a need for fitting a box spring with a system that facilitates the securing of the bed skirt to the edges of the box spring so that it retains its functional and aesthetic goals. This allows the bed skirt to be removed or replaced with the original benefits. When purchasing new box springs, this system is removable and can be attached to the new box spring with minimum time and effort.

SUMMARY OF THE INVENTION

The following presents a simplified summary of the invention in order to provide a basic understanding of some aspects of the invention. This summary is not an extensive overview of the invention. Rather than specifically identifying key or critical elements of the invention or to delineate the scope of the invention, its purpose, inter alia, is to present some concepts of the invention in a simplified form as a prelude to the more detailed description that is presented later.

In accordance with one embodiment, a system for securing a bed skirt to a box spring is provided. The system of the present invention may include one or more L-shaped flanges, each L-shaped flange having a top member that is connected to and substantially perpendicular to a lateral member. The outer surface of the top member may further include an adhesive material comprised of a "hook and loop" type fastener, such as Velcro®. The hook and loop fastener is capable of engaging and securing to a corresponding adhesive material such as a mating hook and loop type fastener which is sewn into or comparably secured to the underside of the bed skirt. The lateral member may include a plurality of holes through which a tack, or other comparable securing device, can be punched into in order to secure the one or more L-shaped flanges to one or more edges of the box spring.

The system and method of the present invention can be used with a box spring having a wooden frame utilizing a plurality metal nails or tacks, or alternatively, with a box spring having a metal frame utilizing plastic tacks which penetrate the box spring fabric thus securing the vinyl flange with hook and loop type fastener thereon.

In accordance with another embodiment of the present invention, a method for securing a bed skirt to a box spring is provided. The method includes providing one or more L-shaped flanges having a top member and lateral member, wherein the top member includes a lower adhesive material and the lateral member includes a plurality of holes sized and spaced for a particular securing device such as a nail or tack. The method further includes attaching the one or more L-shape flanges along the length of one or more edges of a box spring. The method further comprises attaching a corresponding upper adhesive material such as a corresponding upper adhesive material which is sewn on or comparably secured to the underside of the bed skirt decking and which is capable of engaging the lower adhesive material located on the top member so that the bed skirt is retained and secured to the L-shaped flange.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other advantages and novel features of the invention will become apparent from the following description of the invention when considered in conjunction with the drawings.

BRIEF DESCRIPTION OF THE DRAWINGS

The drawings, in which like numerals represent similar parts, illustrate generally, by way of example, but not by way of limitation, various embodiments discussed in the present document.

DETAILED DESCRIPTION

The foregoing summary, as well as the following detailed description of certain embodiments of the subject matter set forth herein, will be better understood when read in conjunction with the appended drawings. In the following detailed description, reference is made to the accompanying drawings which form a part hereof, and in which are shown by way of illustration specific embodiments in which the subject matter disclosed herein may be practiced. These embodiments, which are also referred to herein as "examples," are described in sufficient detail to enable those skilled in the art to practice the subject matter disclosed herein. It is to be understood that the embodiments may be combined or that other embodiments may be utilized, and that structural, logical, and electrical variations may be made without departing from the scope of the subject matter disclosed herein. The following detailed description is, therefore, not to be taken in a limiting sense, and the scope of the subject matter disclosed herein is defined by the appended claims and their equivalents.

Figure 1:
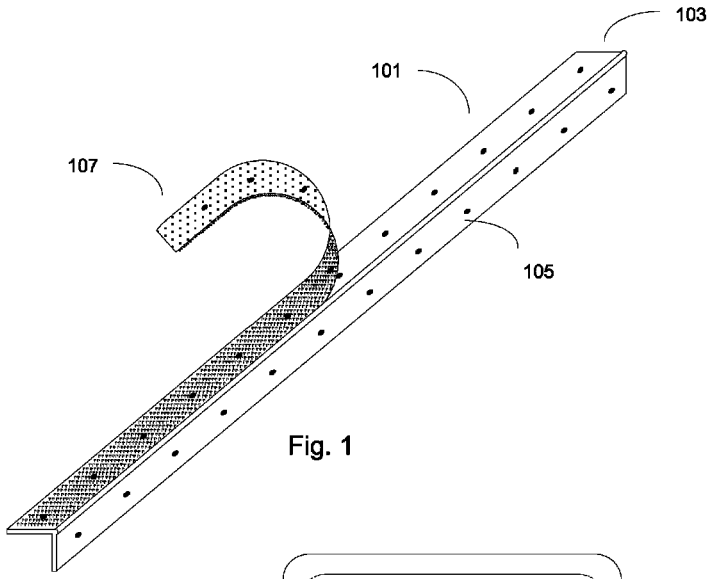
FIG. 1 illustrates the outer surface of the top member of the L-shaped flange having a lower adhesive material comprised of hook and loop fasteners.

FIG. 1 illustrates an L-shaped flange 101, preferably comprised of a vinyl material, having a top member 103 that is connected to and substantially perpendicular to a lateral member 105. The width of the top member 103 and lateral member 105 can be of any desired size, but preferably, the top member and the lateral member should be approximately ½ inch to 1½ inch in width, and even more preferably one inch in width in order to provide enough surface area for attachment of the flange to the box spring and attachment of the bed skirt to the flange as described herein.

FIG. 1 further illustrates a lower adhesive material 107 attached to the top member 103 and preferably comprising a hook and loop fastener such as Velcro®. The L-shaped flange 101 can be of any desired thickness, however, the thinner the flange the better suited for use with the present invention. As an alternative to a hook and loop fastener, the adhesive material 107 may comprise a double sided tape, non-woven polypropylene material, or any other material which will mate with or secure to a corresponding strip or material located on the underside of the bed skirt.

Figure 2:
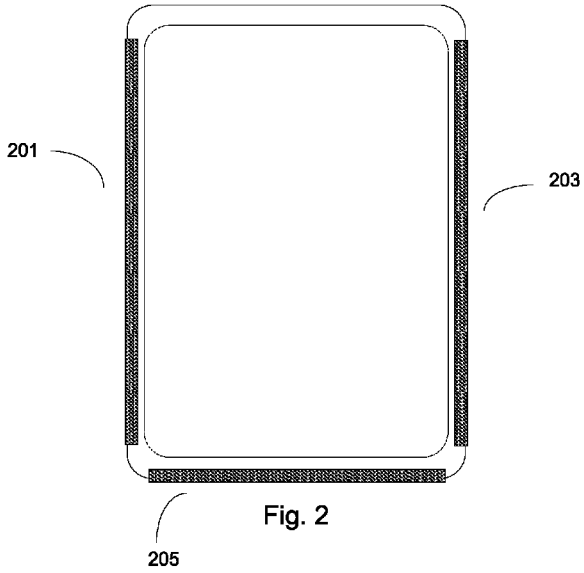
FIG. 2 illustrates the L-shaped flange of the present invention attached to three separate edges of a box spring.

When the L-shaped flange is attached to the one or more edges of the box spring, the top member is substantially parallel with the horizontal surface of the box spring, so that it does not interfere with or abut the hand of the user when the user's hand is passed along the surface of the bed skirt while making the bed. As shown in FIG. 2, preferably an L-shaped flange is attached to each lateral edge of the box spring 201, 203 and another L-shaped flange is attached to the lower edge or end of the box spring 205. As further depicted in FIG. 2, the L-shaped flange should preferably run along the entire edge of the box spring, but preferably, the L-shaped flange should begin and stop short several inches away from the corner of the box spring.

In yet another embodiment of the present invention, a plurality of plastic T-Tacks, or an equivalent securing device, are used to secure the lateral member of the L-shaped flange to the box spring fabric by punching the tacks through a plurality of spaced apart holes provided in the lateral member. Utilizing T-Tacks to attach the L-shaped flange to the box spring fabric allows the L-shaped flange to be attached to, removed from, or re-adjusted on the box spring without damaging the box spring. In yet another embodiment of the present invention, a tacking gun may be used for attaching the one or more L-shaped flanges to one or more edges of the box spring. Alternatively, if the box spring is comprised of a wood frame, the lateral flange or top flange of the L-shaped flange can be nailed to the box spring.

Once the L-shaped flange is secured to the one or more edges of the box spring, the lateral member should be substantially parallel with a vertical side of the box spring and the top member should be substantially parallel with the horizontal surface of the box spring.

Figure 3:
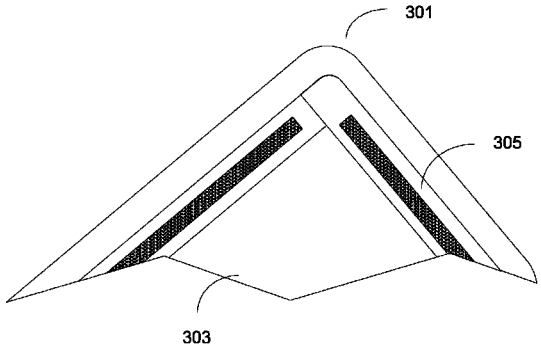
FIG. 3 illustrates of the underside of a bed skirt having a corresponding hook and loop fastening strip.

As depicted in FIG. 3, a bed skirt 301 is also provided having a top side (not depicted) and an underside 303, wherein a corresponding upper adhesive material 305, preferably comprised of corresponding upper material of a hook and loop fastener, is sewn to or comparably secured to the underside 303 of the bed skirt, preferably along the one or more borders of the underside of the bed skirt decking, so that when the upper adhesive material 305 is secured to the corresponding lower adhesive material on the top member of the L-shaped flange, the bed skirt is securely retained on the box spring in a desired orientation.

In another embodiment of the present invention, a plurality of holes is provided in the top member to further assist in securing the lower adhesive material to the top member of the L-shaped flange. While any suitably equivalent securing device can be used, preferably, a "T-tack" fastener, such as a swift tack, swift tag, tagging pin, or Swiftach®, is used to secure the lower adhesive material so that when the head of the T-tack is exposed on the outer surface of the lower adhesive material it will be flush with the surface of the lower adhesive material so as to not interfere with the making of the bed when the user runs his or her hand along the surface of the bed skirting. The T-tack is not visible, exposed, or felt on the top side of the decking of the skirt.

In an alternative embodiment of the present invention, the entire surface of the underside of the bed skirt decking is comprised of an upper adhesive material having an equivalent function to a hook-and-loop fastener such as a non-woven polypropylene material or Veltex® laminated loop fabric, designed for engagement with the hook fastener, which allows attachment of the bed skirt to the L-shaped flanges secured to the one or more edges of the box spring without requiring that the underside of the bed skirt is fitted with substantially aligned and corresponding lower adhesive material.

Figure 4:
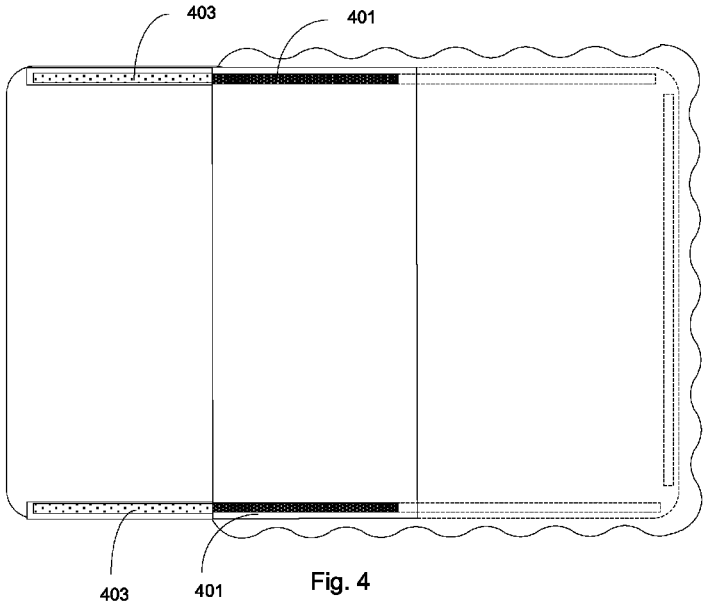
FIG. 4 illustrates the bed skirt with corresponding hook and loop fastening strip being secured to the L-shaped flange attached to the box spring.
Figure 5:
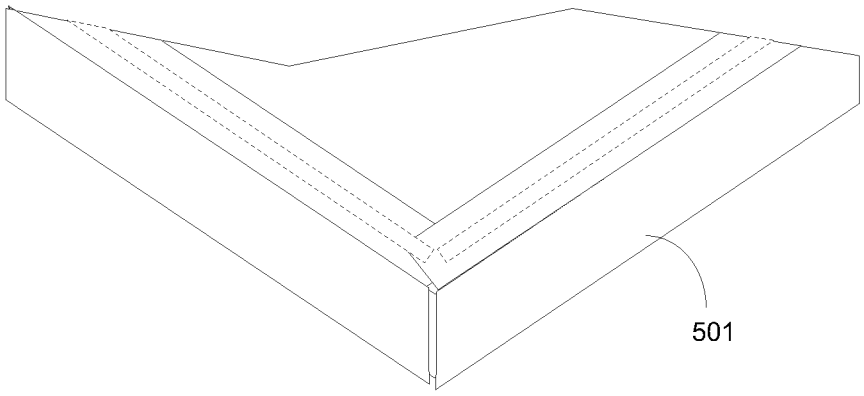
FIG. 5 illustrates the bed skirt secured to the box spring.

As shown in FIG. 4 the bed skirt edge 401 with the corresponding upper adhesive material secured to its underside is attached to the corresponding lower adhesive material 403 on the top member of the L-shaped flange which has been secured to the edge or the box spring. As shown in FIG. 5 the lower adhesive material on the top member of the L-shaped flange and corresponding lower adhesive material on the underside of the bed skirt decking are aligned so that when the bed skirt 501 is secured to the one more edges of the box spring, the bed skirt retains its desired functional and aesthetic goals.

The present invention further comprises a method for attaching one or more L-shaped flanges to the one or more edges of a box spring to better secure and retain a bed skirt thereon. The method preferably comprises the steps of providing one or more L-shaped flanges, preferably comprised of a vinyl material and having a top member connected to and substantially perpendicular to a lateral member. A lower adhesive material, preferably a hook and loop fastener, is attached to the top member of the L-shaped flange. The top member of the L-shaped flange may further provide a plurality of spaced apart holes whereby a plastic T-Tack, or an equivalent securing device, can be punched or inserted therethrough to further secure the lower adhesive material to the top member. Preferably, the holes are spaced approximately between 4 and 8 inches from one another, and even more preferably approximately 6 inches from one another in order to uniformly secure the flange to the box spring.

The method further comprises attaching the one or more L-shaped flanges to one or more box spring edges by punching plastic T-Tacks, or an equivalent securing device, through a plurality of spaced holes on the lateral member of the L-shaped flanges. The method of the present invention further comprises the step of providing a bed skirt decking with a top side and an underside and providing a corresponding upper adhesive material, preferably comprised of a hook and loop type fastener, to a the underside of the bed skirt decking. Alternatively, the entire underside of the bed skirt decking comprises a non-woven polypropylene material which can secure to the lower adhesive material on the top member at any point along the underside of the bed skirt decking.

Once the one or more L-shaped flanges have been secured to one or more edges of the box spring, the method of the present invention further comprises the step of attaching the upper adhesive material on the underside of the bed skirt decking to the corresponding lower adhesive material located on the top member of the one or more L-shaped flanges which have been secured to the one or more edges of the box spring. Preferably, the corresponding lower adhesive material on the top member of the L-shaped flange and the upper adhesive material on the underside of the bed skirt decking are aligned so that when secured to one another, the bed skirt is oriented in such a manner that it achieves and retains its functional and aesthetical goals.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description.

What is claimed is:

1. A system for securing a bed skirt to a box spring, the system comprising:

an elongated L-shaped flange having a top member that is connected to and substantially perpendicular to a lateral member, the L-shaped flange fittable over an upper edge of the box spring;

a lower adhesive material attached to said top member;

a bed skirt decking having a top side and an underside, said underside having an upper adhesive material disposed thereon to correspondingly attach and secure to said lower adhesive material attached along a portion of said top member;

a plurality of spaced apart holes formed in said top member;

a plurality of first securing devices extending through said plurality of said spaced apart holes formed in said top member, wherein said plurality of first securing devices secure said lower adhesive material to said top member;

a plurality of spaced apart holes formed in said lateral member; and a plurality of second securing devices provided through said plurality of said spaced apart holes formed in said lateral member, wherein said plurality of second securing devices secure said lateral member to said box spring.

2. The system of claim 1, said L-shape flange comprising a vinyl flange.

3. The system of claim 1, said top member having a width of approximately between ½ inch to 1½ inches.

4. The system of claim 1, said lateral member having a width of approximately ½ inch to 1½ inches.

5. The system of claim 1, said lower adhesive material comprising a hook and loop fastener.

6. The system of claim 5, said upper adhesive material comprising a hook and loop fastener.

7. The system of claim 1, said lower adhesive material comprising a non-woven polypropylene material.

8. The system of claim 7, said upper adhesive material comprising a non-woven polypropylene material.

9. The system of claim 1, said upper adhesive material being disposed along one or more edges of said underside of said bed skirt decking.

10. The system of claim 1, said upper adhesive material being disposed along the entire surface of said underside of said bed skirt decking.

11. The system of claim 1, said plurality of first and second securing devices comprising a plurality of nails.

12. A method for securing a bed skirt to a box spring, said method comprising the steps of:

providing an L-shaped flange having a top member that is connected to and substantially perpendicular to a lateral member, the top member having a plurality of spaced apart holes, the lateral member having a plurality of spaced apart holes, a lower adhesive strip secured to said top member with a plurality of first securing devices, said first securing devices extending through said plurality of spaced apart holes in said top member;

securing said lateral member to a first edge of said box spring with a plurality of second securing devices, said second securing devices extending through said plurality of spaced apart holes in said lateral member;

providing a bed skirt decking having an underside, an upper adhesive material secured to said underside of said bed skirt decking; and securing said upper adhesive material to said lower adhesive material attached to said top member.

13. The method of claim 12 further comprising providing a second L-shaped flange having substantially the same construction as the L-shaped flange; and securing the lateral member of the second L-shaped flange to a second edge of said box spring.

14. The method of claim 13 further comprising providing a third L-shaped flange having substantially the same construction as the L-shaped flange and the second L-shaped flange; and securing the lateral member of the third L-shaped flange to a third edge of said box spring.

15. The method of claim 12 further comprising the step of securing said lateral member so that the end of said L-shaped flange stops short of the corner of said box spring.

16. A system for securing a bed skirt to a box spring, the box spring having an upper edge defined at the intersecting edge between a top surface of the box spring and at least one lateral surface of the box spring, the bed skirt including a bed skirt decking as well as a hanging portion of the bed skirt extending along at least a portion of the at least one lateral surface of the box spring when the bed skirt is secured to the box spring, the system comprising:

a first elongated flange having a top member and lateral member joined with the top member, the top member oriented substantially perpendicular to the lateral member, the first elongated flange fittable over the upper edge of the box spring;

a second elongated flange having a top member and lateral member joined with the top member, the top member oriented substantially perpendicular to the lateral member, the second elongated flange fittable over the upper edge of the box spring, the first and second elongated flanges spaced from each other when each is respectively fitted to the upper edge of the box spring;

a lower adhesive material extending along at least a portion of the top member of at least one of the first or second elongated flanges;

an upper adhesive material extending along a portion of the underside surface of the bed skirt decking, the upper adhesive material oriented to correspondingly attach to the lower adhesive material as the bed skirt is placed on the box spring with the fitted first and second elongated flanges;

a plurality of securing devices operable to secure the first and second elongated flanges to the box spring when the first and second elongated flanges are fitted to the upper edge of the box spring.

17. The system of claim 16, further comprising:

a third elongated flange having a top member and lateral member joined with the top member, the top member oriented substantially perpendicular to the lateral member, the third elongated flange fittable over the upper edge of the box spring, the third elongated flanged spaced from the first and second elongated flanges when each elongated flange is respectively fitted to the upper edge of the box spring.

18. The system of claim 17, wherein the first and second elongated flanges are substantially parallel to each other when fitted over the upper edge of the box spring, and the third elongated flange is substantially perpendicular to the first and second elongated flanges when fitted over the upper edge of the box spring.

19. The system of claim 16, further comprising:

a plurality of holes formed in the top member of the at least one of the first and second flanges having the lower adhesive material, each of the plurality of holes spaced from one another; and a plurality of first securing devices each extending through one of the plurality of holes formed in the top member, the plurality of first securing devices thereby securing the lower adhesive material to the top member of the at least one of first and second flanges.

20. The system of claim 16, further comprising:

a plurality of holes formed in the lateral member of each of the first and second flanges; and a plurality of second securing devices each extending through one of the plurality of holes formed in the lateral members of each of the first and second flanges, the plurality of second securing devices thereby securing the lateral members of each of the first and second flanges to the box spring.

* * * * *